US009589454B2

(12) United States Patent
Vaidhyanathan et al.

(10) Patent No.: US 9,589,454 B2
(45) Date of Patent: Mar. 7, 2017

(54) METHOD, APPARATUS AND SYSTEM FOR BROADCASTING AN ALARM FOR AN ALARM GROUP

(71) Applicant: Verizon Patent and Licensing Inc., Arlington, VA (US)

(72) Inventors: Aravind Vaidhyanathan, Tamil Nadu (IN); Venkatesan M. Sriraman, Tamil Nadu (IN); Sivasubramanian Parthasarathy, Pondicherry (IN); Vijayan Radhakrishnan, Tamil Nadu (IN); Kavitha Panneerselvam, Tamil Nadu (IN); JanardhanReddy Tripuram, Telangana (IN); Deepak Natarajan, Tamil Nadu (IN)

(73) Assignee: Verizon Patent and Licensing Inc., Basking Ridge, NJ (US)

( * ) Notice: Subject to any disclaimer, the term of this patent is extended or adjusted under 35 U.S.C. 154(b) by 49 days.

(21) Appl. No.: 14/480,361

(22) Filed: Sep. 8, 2014

(65) Prior Publication Data

US 2016/0071403 A1 Mar. 10, 2016

(51) Int. Cl.
*G08B 23/00* (2006.01)
*G08B 27/00* (2006.01)

(52) U.S. Cl.
CPC ..... *G08B 27/00* (2013.01); *G08B 27/005* (2013.01); *G08B 27/006* (2013.01); *G08B 27/008* (2013.01)

(58) Field of Classification Search
CPC .... G08B 29/02; G08B 25/009; G08B 25/085; G08B 25/14; H04W 4/06; H04W 4/04; H04W 4/22; H04W 4/028
USPC ... 340/506, 539.1, 502, 12.5, 531, 501, 540, 340/539.11, 686.6; 455/418, 404.2, 458, 455/404.1, 519; 709/223, 206, 204, 203; 705/7.19; 715/716, 734, 735, 736
See application file for complete search history.

(56) References Cited

U.S. PATENT DOCUMENTS 6,816,878 B1 * 11/2004 Zimmers ..... G08B 27/005 340/540
7,026,926 B1 * 4/2006 Walker, III ..... G08B 27/00 340/506
7,468,934 B1 * 12/2008 Janik ..... G04G 11/00 368/13
8,290,603 B1 * 10/2012 Lambourne ..... G11B 27/00 381/104
8,423,378 B1 * 4/2013 Goldberg ..... G06Q 50/22 705/2
RE44,535 E * 10/2013 Zimmers ..... 702/3
2002/0068587 A1 * 6/2002 Chapman ..... G07C 1/10 455/461
2003/0020623 A1 * 1/2003 Cao ..... G01C 21/20 340/686.6
2004/0242190 A1 * 12/2004 Cho ..... H04H 20/12 455/404.1

(Continued)

*Primary Examiner* — Hoi Lau

(57) ABSTRACT

An approach for broadcasting an alarm to a plurality of devices associated with an alarm group. The alarm is associated with a plurality of devices in an alarm group. The approach includes receiving a request. The request designates a plurality of devices as the alarm group. The approach includes determining an implementation of the alarm for the alarm group based on the request. The approach also includes broadcasting the alarm to the plurality of devices in the alarm group based on the implementation.

20 Claims, 10 Drawing Sheets

(56) References Cited

U.S. PATENT DOCUMENTS

2005/0152288 A1* 7/2005 Datla ..... H04L 41/0613 370/256
2005/0200487 A1* 9/2005 O'Donnell ..... A62B 99/00 340/573.1
2005/0261012 A1* 11/2005 Weiser ..... H04L 12/1895 455/466
2006/0046761 A1* 3/2006 Bishop ..... H04M 3/02 455/519
2006/0168087 A1* 7/2006 Lescuyer ..... H04L 12/581 709/207
2006/0187897 A1* 8/2006 Dabbs, III ..... H04W 4/06 370/349
2006/0281980 A1* 12/2006 Randlov ..... A61B 5/14532 600/301
2007/0087791 A1* 4/2007 Feeney ..... A63F 13/12 455/567
2007/0136743 A1* 6/2007 Hasek ..... G08B 25/085 725/33
2007/0252688 A1* 11/2007 Eisold ..... G08B 27/008 340/506
2007/0296575 A1* 12/2007 Eisold ..... G08B 27/006 340/539.16
2010/0180232 A1* 7/2010 Honan ..... G06Q 30/02 715/811
2010/0219948 A1* 9/2010 Egawa ..... G08B 21/12 340/531
2010/0295677 A1* 11/2010 Egawa ..... G08B 3/10 340/540
2011/0018705 A1* 1/2011 Egawa ..... G08B 17/10 340/539.1
2011/0018706 A1* 1/2011 Egawa ..... G08B 25/009 340/539.1
2011/0025490 A1* 2/2011 Egawa ..... G08B 17/00 340/514
2011/0034183 A1* 2/2011 Haag ..... G06Q 50/26 455/456.3
2012/0008526 A1* 1/2012 Borghei ..... H04W 4/021 370/254
2012/0068842 A1* 3/2012 Piccolo, III ..... G08B 25/14 340/501
2012/0218099 A1* 8/2012 Egawa ..... G08B 25/009 340/502
2013/0091262 A1* 4/2013 Rajakarunanayake ..... G06Q 30/00 709/223
2013/0111511 A1* 5/2013 Besehanic ..... H04N 21/482 725/14
2013/0157609 A1* 6/2013 Vainik ..... G06F 11/0781 455/404.1
2013/0243199 A1* 9/2013 Kallai ..... G11B 19/02 381/17
2013/0325951 A1* 12/2013 Chakra ..... H04L 51/24 709/204
2014/0074535 A1* 3/2014 Woo-Kwan-Chung ..... G06Q 10/1095 705/7.19
2014/0214979 A1* 7/2014 Turakhia ..... H04L 12/1895 709/206
2014/0269465 A1* 9/2014 Ballantyne ..... H04W 4/06 370/311
2014/0269483 A1* 9/2014 Ballantyne ..... H04W 4/08 370/312
2014/0273909 A1* 9/2014 Ballantyne ..... H04W 4/22 455/404.1
2014/0273910 A1* 9/2014 Ballantyne ..... H04W 4/22 455/404.1
2015/0038179 A1* 2/2015 Mohanty ..... H04W 4/06 455/458
2015/0099481 A1* 4/2015 Maitre ..... H04W 4/22 455/404.2
2015/0140990 A1* 5/2015 Kim ..... H04W 8/186 455/418
2015/0235542 A1* 8/2015 Su ..... G08B 29/02 340/506
2015/0339917 A1* 11/2015 Messing ..... G08C 17/02 340/12.5
2016/0071403 A1* 3/2016 Vaidhyanatan ..... G08B 27/00 340/502

* cited by examiner

400

METHOD, APPARATUS AND SYSTEM FOR BROADCASTING AN ALARM FOR AN ALARM GROUP

BACKGROUND OF THE INVENTION

Oftentimes, groups of individuals, who are located at remote locations from each other, seek to coordinate their schedules using devices at the remote locations. A common object of such coordinating efforts is to schedule an alarm, such as a wake-up alarm, for the individuals in the group. However, such coordinating efforts often require multiple separate communications among the individuals to determine a time for the alarm. Also, once the initial scheduling and/or coordinating is agreed, a subsequent scheduling effort to change the scheduled alarm commonly requires additional multiple communications to ensure all the members of the groups of individuals are apprised of the change.

The processes of scheduling and rescheduling of such alarms are fraught with potential failures to implement and/or to communicate the scheduled and/or rescheduled alarms at the remotely located devices. Furthermore, even when the scheduled alarms are accurately communicated, the remote nature of the owners associated with the devices often leaves one or more members in the group inadequately notified by the scheduled alarm to participate in the function associated with the scheduled group alarm. Also, it is often difficult for the remotely located members to be assured that all the group members have been adequately notified by an alarm. This difficulty is particularly acute for remotely scheduled alarms that are wake-up alarms. This is because the individuals are needed to pass from a sleeping state to consciousness at the wake-up alarm and commonly fail to attain consciousness, despite the alarm.

Based on the foregoing, there is a desire for a method, apparatus and system for processing group alarm information and communicating a group alarm for an alarm group, such as a wake-up alarm, which are more efficient and effective for scheduling and broadcasting a group alarm for an alarm group.

BRIEF DESCRIPTION OF THE DRAWINGS

Various exemplary embodiments are illustrated by way of example, and not by way of limitation, in the figures of the accompanying drawings in which like reference numerals refer to similar elements and in which.

DETAILED DESCRIPTION OF THE PREFERRED EMBODIMENTS

A method, apparatus and system for broadcasting a group alarm for an alarm group are described. The embodiments of the invention provide a system whereby processing group alarm information and communicating a group alarm for an alarm group, such as a wake-up alarm, are performed efficiently and effectively for scheduling and broadcasting the alarm. In the following description, for the purposes of explanation, numerous specific details are set forth in order to provide a thorough understanding of the present invention. As is well known, the present invention may be practiced without these specific details or with an equivalent arrangement. In other instances, well-known structures and devices are shown in block diagram form in order to avoid unnecessarily obscuring the present invention.

Figure 1A:
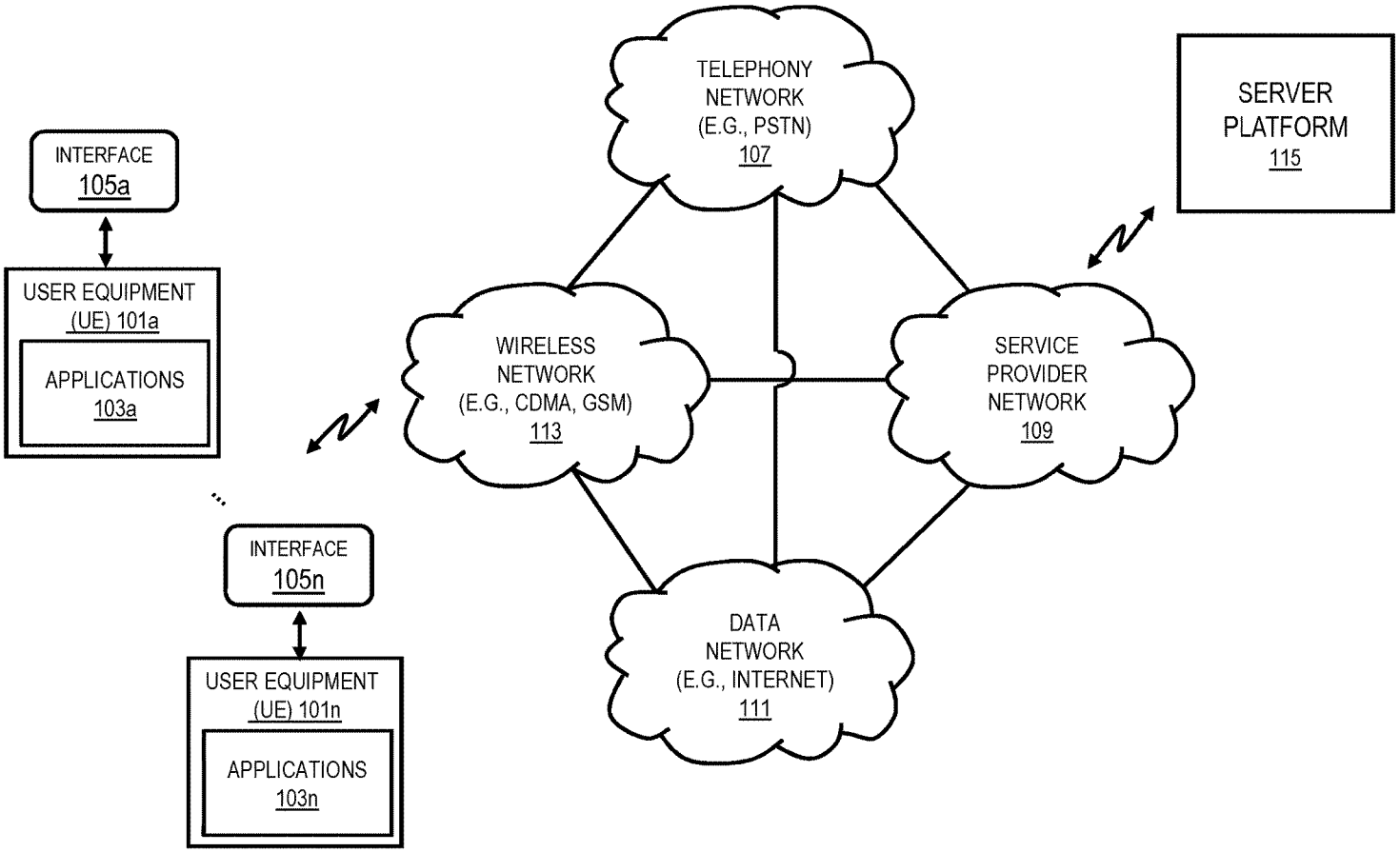
FIG. 1A-1B are diagrams of architectures for broadcasting an alarm for an alarm group, according to two exemplary embodiments.

As shown in FIG. 1A, the system 100 comprises user equipment (UE) 101*a*-101*n* (collectively referred to as UE 101) for collecting and transmitting group alarm information regarding a group alarm for an alarm group that may include or be associated with applications 103*a*-103*n* (collectively referred to as applications 103) for processing the group alarm information and interfaces 105*a*-105*n* (collectively referred to as interfaces 105) for collecting/receiving group alarm information based on UE 101 associated with the alarm group. In one embodiment, the UE 101 has connectivity to a server platform 115 via networks 107-113. In one embodiment, the server platform 115 performs one or more functions associated with receiving requests designating the UE 101 as an alarm group, determining an implementation of an alarm for the alarm group, broadcasting the alarm to the UE 101 in the alarm group and combinations thereof.

By way of example, the UE 101 may be a receiver and/or transmitter for alarm information and may be used as a standalone device or utilized in conjunction with other user equipment such as a smart-phone, a tablet, an alarm clock, a sound system and a personal computer. The UE 101 may be any type of mobile terminal, fixed terminal, or portable terminal including a mobile handset, station, unit, device, multimedia computer, multimedia tablet, Internet node, communicator, desktop computer, laptop computer, notebook computer, netbook computer, tablet computer, personal communication system (PCS) device, personal navigation device, personal digital assistants (PDAs), audio/video player, digital camera/camcorder, positioning device, television receiver, radio broadcast receiver, electronic book device, game device, or any combination thereof, including the accessories and peripherals of these devices, or any combination thereof. It is also contemplated that the UE 101 can support any type of interface to the user such as "wearable" circuitry, etc.

By way of example, the applications 103 may be a remote personal alarm software solution intended to collect and store data associated with implementing a group alarm using personal devices, such as those intended for use in the home or a temporary sleeping location, such as a hotel, an airplane, a car, a vacation home, etc. The applications 103 may be any type of application that is executable at the UE 101, such as media player applications, social networking applications, calendar applications, content provisioning services, location-based service applications, navigation applications and the like. In one embodiment, one of the applications 103 at the UE 101 may act as a client for the server platform 115 and may perform one or more functions associated with the functions of the server platform 115, such as by interacting with the server platform 115 over the networks 107-113, or by incorporating applications which may be utilized independently at the server platform 115.

By way of example, the interfaces 105 may be input screens for accepting data utilized in conjunction with requesting an alarm, acknowledging an alarm, and acknowledging an implementation of a group alarm involving the UE 101. By way of example, the interface 105 may be any type of interface. In certain embodiments, the interface 105 may include, for example, a global positioning sensor for gathering location data (e.g., GPS), a network detection sensor for detecting wireless signals or receivers for different short-range communications (e.g., Bluetooth, WiFi, Li-Fi, near field communication, etc.), temporal information, a camera/imaging sensor for gathering image data, an audio recorder for gathering audio data, and the like. In one scenario, the interface 105 may include, light sensors, oriental sensors augmented with height sensor and acceleration sensor, tilt sensors, moisture sensors, pressure sensors, audio sensors (e.g., microphone), gaze tracking sensors etc.

For illustrative purposes, the networks 107-113 may be any suitable wireline and/or wireless network, and be managed by one or more service providers. For example, telephony network 107 may include a circuit-switched network, such as the public switched telephone network (PSTN), an integrated services digital network (ISDN), a private branch exchange (PBX), or other like network. Wireless network 113 may employ various technologies including, for example, code division multiple access (CDMA), enhanced data rates for global evolution (EDGE), general packet radio service (GPRS), mobile ad hoc network (MANET), global system for mobile communications (GSM), Internet protocol multimedia subsystem (IMS), universal mobile telecommunications system (UMTS), etc., as well as any other suitable wireless medium, e.g., microwave access (WiMAX), wireless fidelity (WiFi), satellite, and the like. Meanwhile, data network 111 may be any local area network (LAN), metropolitan area network (MAN), wide area network (WAN), the Internet, or any other suitable packet-switched network, such as a commercially owned, proprietary packet-switched network, such as a proprietary cable or fiber-optic network.

Although depicted as separate entities, networks 107-113 may be completely or partially contained within one another, or may embody one or more of the aforementioned infrastructures. For instance, the service provider network 109 may embody circuit-switched and/or packet-switched networks that include facilities to provide for transport of circuit-switched and/or packet-based communications. It is further contemplated that networks 107-113 may include components and facilities to provide for signaling and/or bearer communications between the various components or facilities of system 100. In this manner, networks 107-113 may embody or include portions of a signaling system 7 (SS7) network, or other suitable infrastructure to support control and signaling functions.

In one embodiment, the server platform 115 may be a platform with multiple interconnected components for processing group alarm information. The server platform 115 may include multiple servers, intelligent networking devices, computing devices, components and corresponding software for configuring one or more user interface elements for facilitating an installation of a device, a service, or a combination thereof. In addition, it is noted that the server platform 115 may be a separate entity of the system 100, or be included within the UE 101 (e.g., as part of the applications 103).

In one embodiment, the server platform 115 may receive a request designating a plurality of devices as an alarm group and include instructions regarding generating a personalized alarm. The instructions may specify one or more aspects of the group alarm (e.g., an alarm time and an alarm type, such as a voice capture, a video capture, a selected tone, a selected rhythm, a selected signal, etc.), or a combination thereof. In one scenario, the server platform 115 may present a user interface for inputting an alarm request at the server platform 115. As an alternative, a user of system 100, such as a person organizing a group associated with a group alarm, may transmit an alarm request that is received at the server platform 115.

Figure 1B:
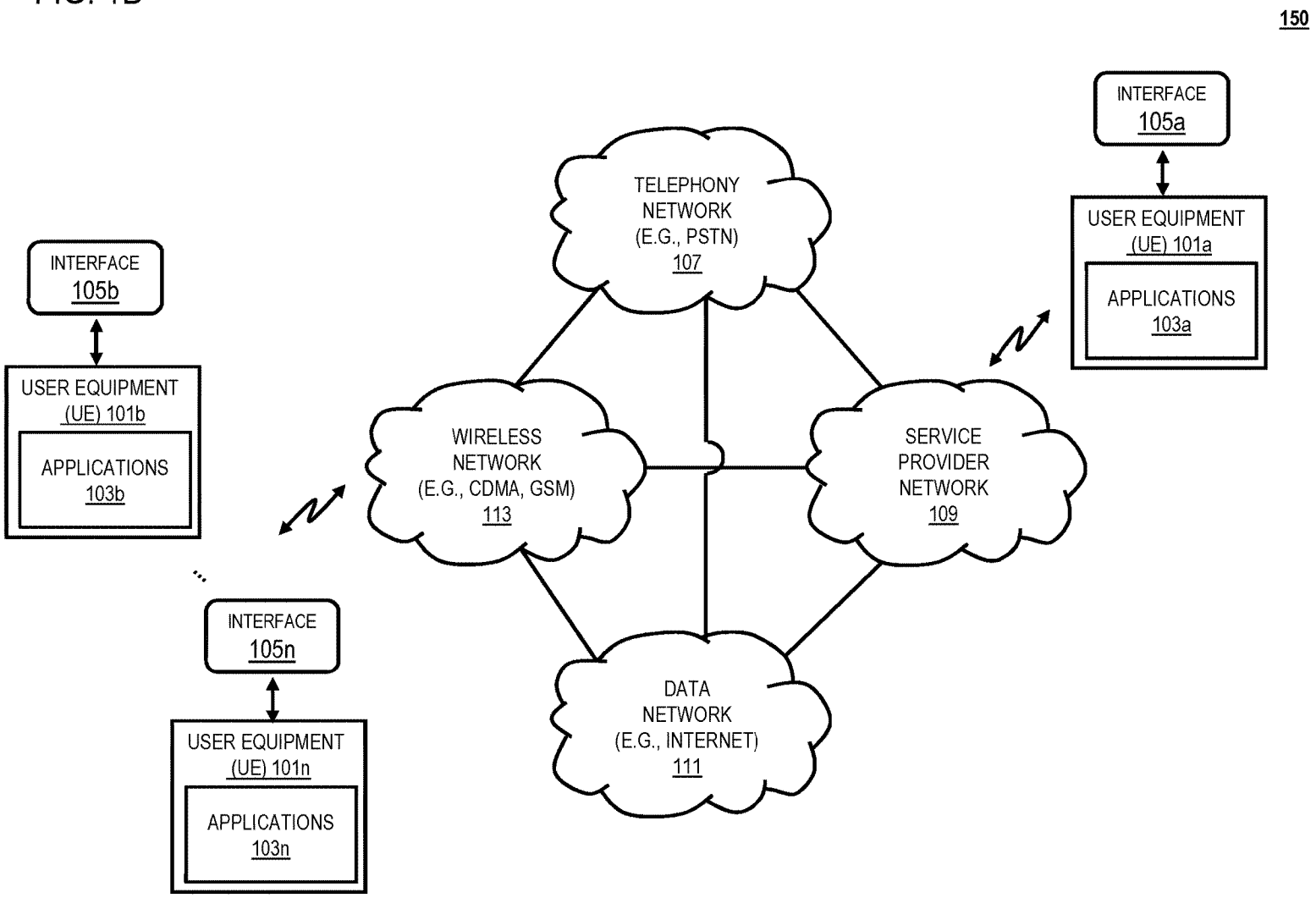

As shown in FIG. 1B, a UE, such as the UE 101*a*, may replace a server platform, such as the server platform 115. The UE 101*a* may receive a request designating a plurality of devices as an alarm group and include instructions regarding generating a personalized alarm. In one embodiment, the UE 101*a* may be a platform and operate in an analogous fashion as the server platform 115, with multiple interconnected components in the applications 103*a* for processing group alarm information.

Figure 2:
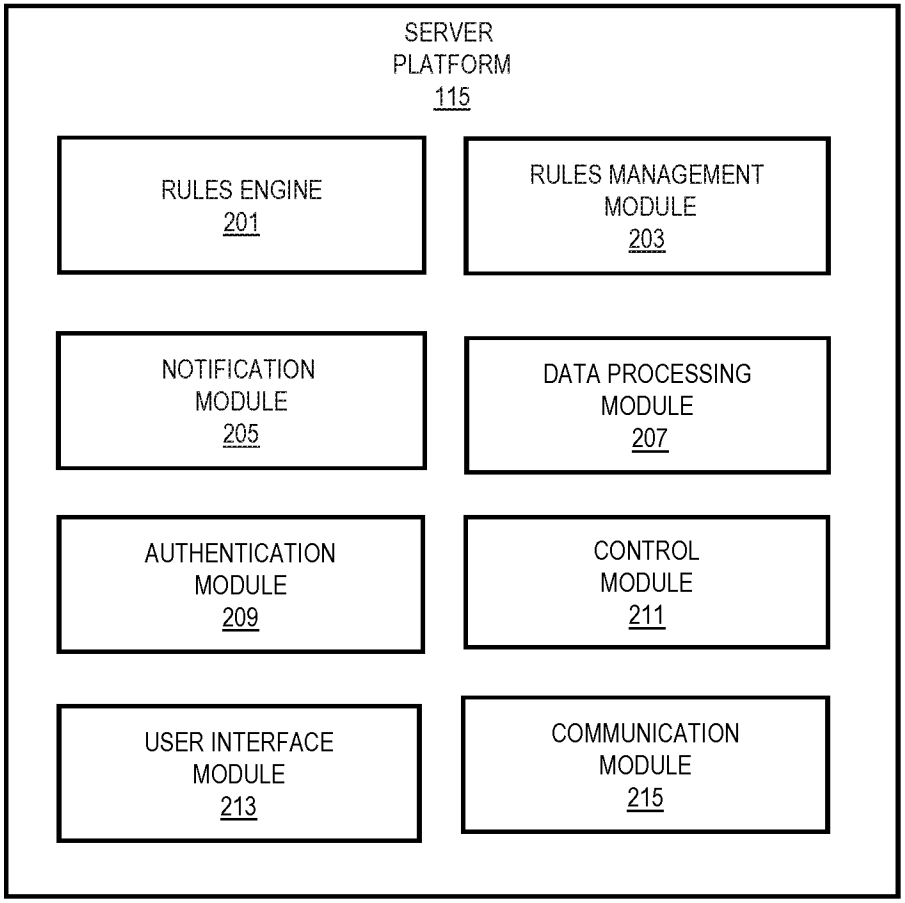
FIG. 2 is a diagram of components of a platform for broadcasting an alarm for an alarm group in a service provider network, according to an exemplary embodiment.

FIG. 2 is a diagram of the components of the server platform 115, according to one embodiment. By way of example, the server platform 115 includes one or more components for receiving requests, instructions and other data relating to implementing and/or broadcasting an alarm for an alarm group. It is contemplated that the functions of the components of the server platform 115 may be combined in one or more components or performed by other components of equivalent functionality. In this embodiment, the server platform 115 includes a rules engine 201, a rules management module 203, a notification module 205, a data processing module 207, an authentication module 209, a control module 211, a user interface module 213 and a communication module 215.

In one embodiment, the rules engine 201 processes information relating to designating a plurality of devices as an alarm group and selecting an implementation of an based on an alarm condition associated with any one of the plurality of devices, a device preference, a group preference, or a combination thereof. A request processed by the rules engine 201 may be, for example, a request, an updated request, a change notice associated with an activity state of at least one device of the plurality of devices, an implementation acknowledgement associated with an implementation instruction, an alternate implementation acknowledgement associated with an alternate implementation instruction, or a combination thereof.

In one embodiment, the rules management module 203 allows a manager to create, define, modify, and delete rules and workflows that determine when an event in the server platform 115 triggers a status summary update and/or communication with a user, such as a member of the alarm group or a server administrator. A user or the manager may identify exactly what has to happen to trigger a new event (e.g., events can be triggered by certain workgroups, types of users, or a person), and/or there can be exceptions built into the system, for example, conditional logic may be applied to the new trigger.

In one embodiment, the notification module 205 determines when and under what circumstances an alert notification may be associated with a request, a change notice, an implementation acknowledgement, etc., and be reported to a user. The notification module 205 may also initiate a request, a change notice, an implementation acknowledgement, etc.

In one embodiment, the data processing module 207 processes and stores data including group alarm information such as alarm group member device identifiers, group member device status information, records associated with administering a group alarm and notifications utilized by the server platform 115.

In one embodiment, the authentication module 209 authenticates communications associated with the group alarm. The authentication module 209 may periodically communicate with trust sources regarding relevant tracking of the implementation instructions, implementation acknowledgements, change notices associated with the devices, alarm acknowledgements and acknowledged alarm notices.

In another embodiment, the authentication module 209 authenticates UE 101s for interaction with the server platform 115. In one embodiment, the authentication module 209 causes a verification of user information to configure at least one device to a secured network. In another embodiment, the authentication module 209 may detect an error during a user verification process based, at least in part, on predefined values, wherein predefined values include, at least in part, a preset username and password combination, a pin code, one or more identifiers, other authentication mechanisms, or a combination thereof. The authentication process performed by the authentication module 209 may also include receiving and validating a login name and/or user identification value as provided or established for a particular user during a subscription or registration process with the service provider. The login name and/or user identification values may be received as input provided by the user from the UE 101 or other device via a graphical user interface to the server platform 115 (e.g., as enabled by the user interface module 213). Alternatively, the login process may be performed through automated association of profile data for the user and/or UE 101 with an IP address, a carrier detection signal of a user device, mobile directory number (MDN), subscriber identity module (SIM) (e.g., of a SIM card), radio frequency identifier (RFID) tag or other identifiers.

In one embodiment, the control module 211 is used to monitor events that occur in the server platform 115 for analysis using the rules engine 201 and/or the notification module 205.

In one embodiment, the user interface module 213 causes a presentation of one or more administration user interface(s) to assist at least one user in entering an alarm request or an updated alarm request, such as on a display associated with the server platform 115 and/or the UE 101. The user interface module 213 may employ various application programming interfaces (APIs) or other function calls corresponding to the applications 103 of UE 101, thus enabling the display of graphics primitives such as menus, data entry fields, etc., for generating the user interface elements. By way of example, the user interface module 213 generates the interface in response to APIs or other function calls corresponding to the browser application or web portal application of the UE 101, thus enabling the display of graphics primitives.

In one embodiment, the communication module 215 executes various protocols and data sharing techniques for connecting at least one device, such as a UE 101, to a secured network, thereby facilitating a presentation of user interface elements to assist at least one user in configuring at least one device to a secured network. The communication module 215 may be used to communicate a request, an updated request, a change notice associated with an activity state of at least one device of the plurality of devices, an implementation acknowledgement associated with an implementation instruction, an alternate implementation acknowledgement associated with an alternate implementation instruction, etc. By way of example, the communication module 215 may be used to transmit a request from a UE 101 to the server platform 115 for receiving an instruction to personalize an alarm.

Figure 3A:
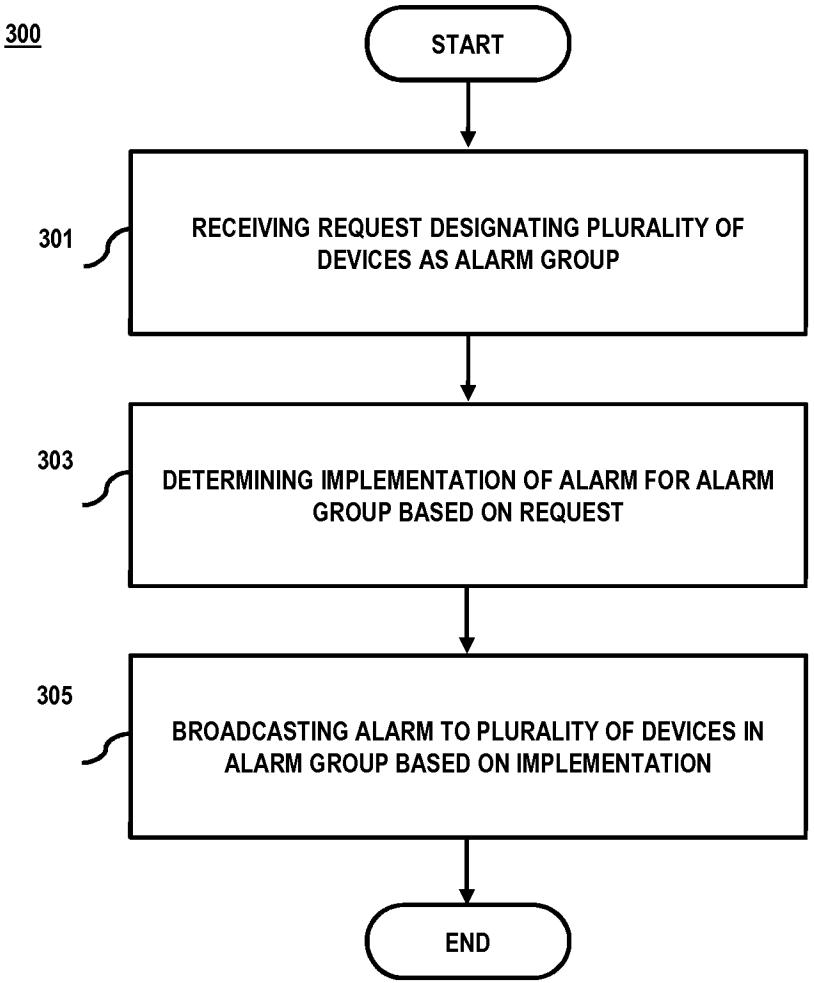
FIG. 3A-3D are flowcharts of processes for broadcasting an alarm for an alarm group, according to various exemplary embodiments.
Figure 5:
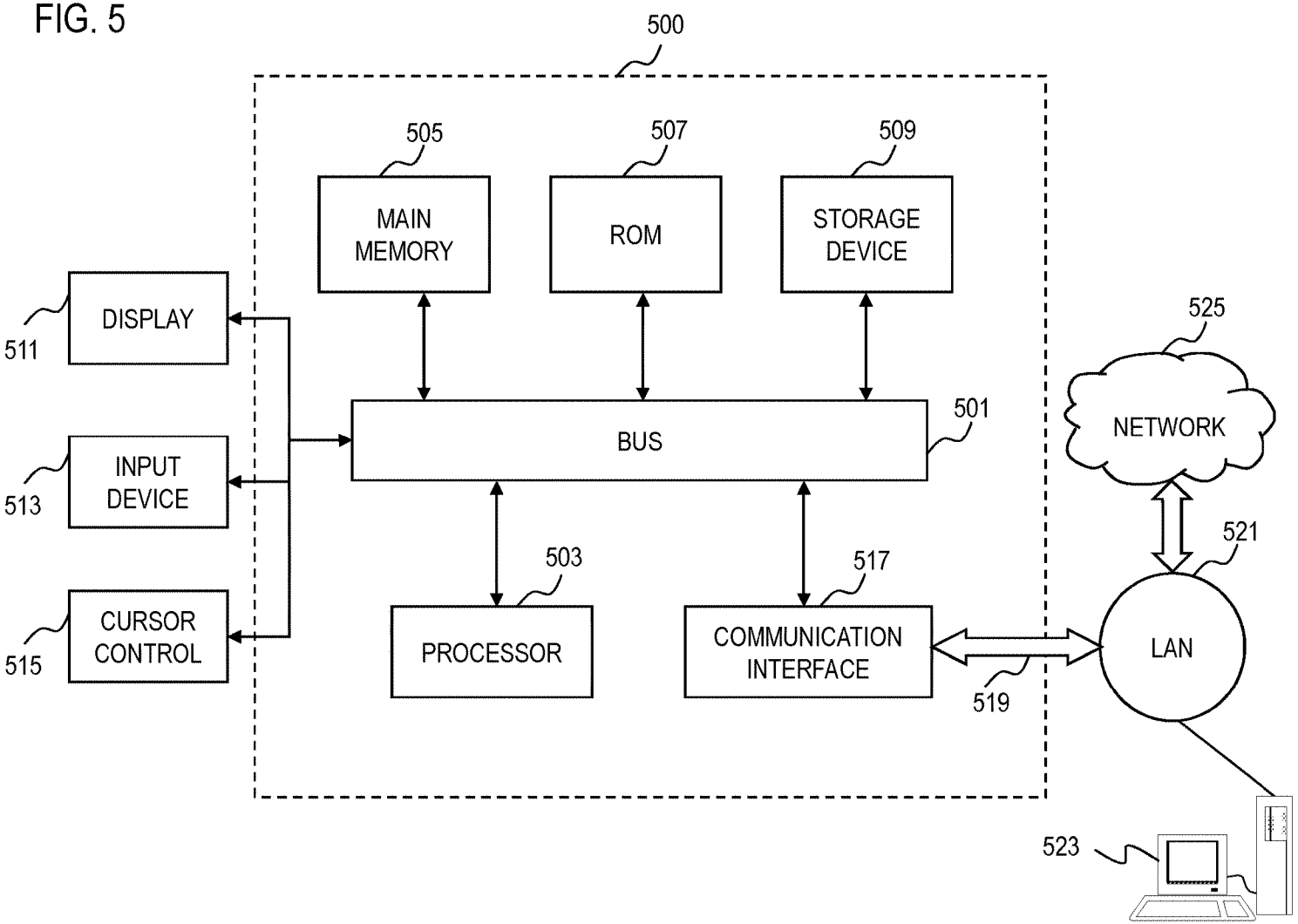
FIG. 5 is a diagram of a computer system that can be used to implement various exemplary embodiments.
Figure 6:
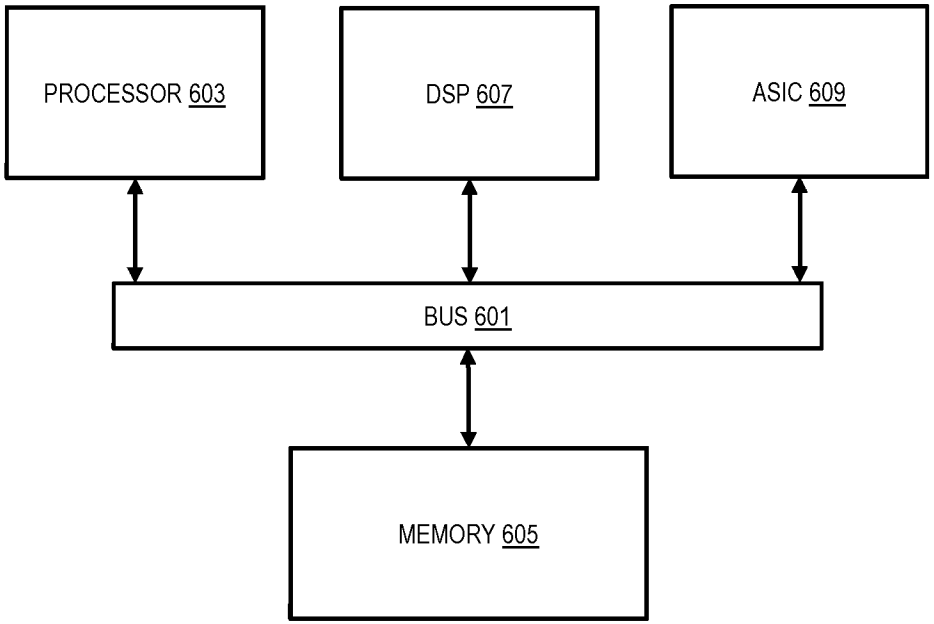
FIG. 6 is a diagram of a chip set that can be used to implement an exemplary embodiment of the invention.

FIG. 3A is a flowchart of a process 300 for receiving a request for an alarm of an alarm group, determining an implementation of the alarm of the alarm group, and broadcasting the alarm, according to one embodiment. In one embodiment, such as shown in FIG. 1A, the server platform 115 performs the process 300 and is implemented in, for instance, a platform including a processor, a memory and a bus as shown in FIG. 5. In another embodiment, such as shown in FIG. 1B, the UE 101*a* performs the process 300 and is implemented in, for instance, a chip set including a processor and a memory as shown in FIG. 6.

In step 301, the server platform 115 receives a request designating a plurality of devices as an alarm group. The received request, which may have originated from a device in the alarm group, is received at the server platform 115 by the communication module 215 and processed by the data processing module 207. In one scenario, the received request is authenticated by the authentication module 209. In other embodiments, the request may be received or initiated using a device not within the alarm group or via a user interface portal of the server platform 115 (e.g., a web-based interface to the server platform 115).

By way of example, designation of the devices may include specifying device identifiers (e.g., phone numbers, hardware identifiers, user names, etc.) for each of the devices within the group. In addition or alternatively, a designation of an alarm group can be based on contextual information such as physical proximity, calendar information (e.g., indicating attendance or participation in a common event or activity), activity information, etc. In one embodiment, physical proximity may be determined using location sensors, near field communications, short range wireless, and/or other equivalent technology. The embodiments described above for designating devices are provided by way of illustration and are not intended as limitations.

In step 303, the server platform 115 determines an implementation of an alarm, such as a wake-up alarm, for the alarm group based on the request. Although various embodiments discuss the alarm as a wake-up alarm, it is contemplated that the approaches described herein are applicable to any type of alarm implementation or notification that is transmitted among the devices with the alarm group. In addition, the implementation may designate a type of alarm to broadcast including specifying parameters such as alarm media (e.g., sounds, graphics, etc.), alarm parameters (e.g., time, duration, repetition, etc.), and the like. The implementation may also designate processes and parameters for implementation of the alarm based on the types of devices associated with the alarm group, the designated "host device" for the alarm session, the available communication networks, the data formats used in the request, etc.

In step 305, the notification module 209 broadcasts the alarm to the plurality of devices in the alarm group based on the implementation processed by the data processing module 207. In one embodiment, broadcasting may include transmitting, e.g., via a communication channel, instructions from an originating device (e.g., an alarm host device, the server platform 115, etc.) to other devices within the alarm group for initiating and/or activating the alarm. For example, the communication channel may include any of the networks 107-113 including, e.g., data channels, voice channels, messaging channels, etc. In some embodiments, when the networks 107-113 are unavailable or not to be used, the broadcast may use non-network based signaling include transfer via near field communications, short range wireless, QR code transmission, Bluetooth, WiFi, etc.

Figure 3B:
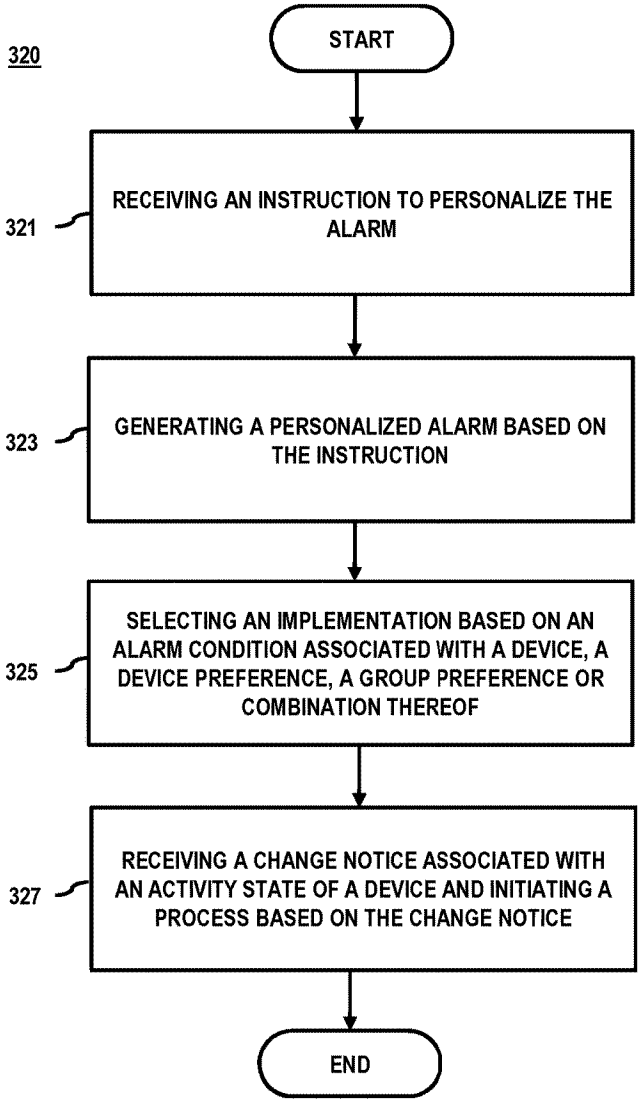
Figure 4:
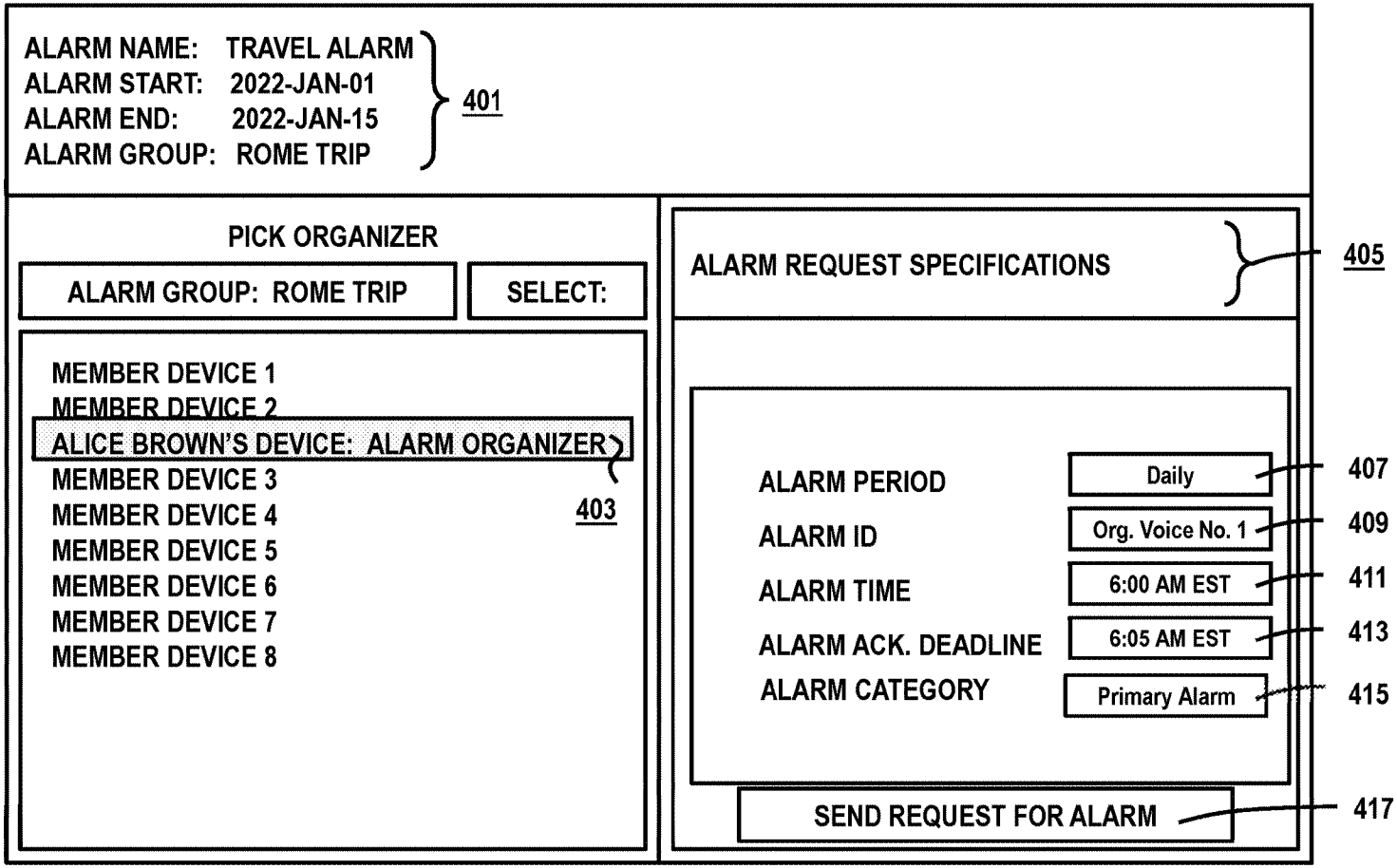
FIG. 4 is graphical representation of a request for an alarm for an alarm group, including instructions, entered via a user interface, according to an exemplary embodiment.

FIG. 3B is a flowchart of a process 340 for receiving an instruction to personalize the alarm and generating a personalized alarm based on the instruction, according to an embodiment. In one embodiment, such as shown in FIG. 4 below, the alarm may be personalized by selecting a voice capture of a member of the alarm group. In other embodiments, the alarm may be personalized using alternative features, such as a video capture, a selected tone, a selected rhythm, a selected signal, or a combination thereof.

In step 321, the server platform 115 receives, as part of the request, an instruction to personalize the alarm via one of the user interface module 213 and the communication module 215 or both modules. Once received, the data processing module 207 may store the instruction with any data and/or content associated with the instruction, such as a voice capture, a video capture, a selected tone, a selected rhythm, a selected signal along with related data such as alarm group member device identifiers, group member device status information, records associated with administering a group alarm. In step 323, the data processing module 207 generates a personalized alarm based on the instruction. In generating the personalized alarm, the data processing module 207 may utilize part or all of the related data, such as the group member device status information in generating the personalized alarm. According to one scenario, group member device status information may be utilized to generate a personalized alarm with alternate timing or other features for a group member device, depending on a group member device status. The personalized alarm may be broadcast via the notification module 209.

In step 325, the server platform 115 selects, utilizing the rules engine 201, an implementation of the alarm based on an alarm condition associated with any one of the plurality of devices, a device preference, a group preference, or a combination thereof. For example, group member device status information associated with a group member device may be utilized in selecting an implementation of an alarm that accounts for whether a group member device has an active connection with the server platform 115 and/or a host device in the alarm group.

In step 327, the server platform 115 receives a change notice associated with an activity state of at least one device of the plurality of devices and, utilizing the rules engines 201, initiates, based on the change notice, a process such as updating the initial request, determining an implementation, determining an alternate implementation, the broadcasting of the alarm, a broadcasting of an alternate alarm, or a combination thereof. For example, a change notice regarding group member device status information associated with a group member device may be received and utilized to determine an alternate implementation of a group alarm, a personalization associated with the alarm, a designation of the host device for the group alarm, and the like.

Figure 3C:
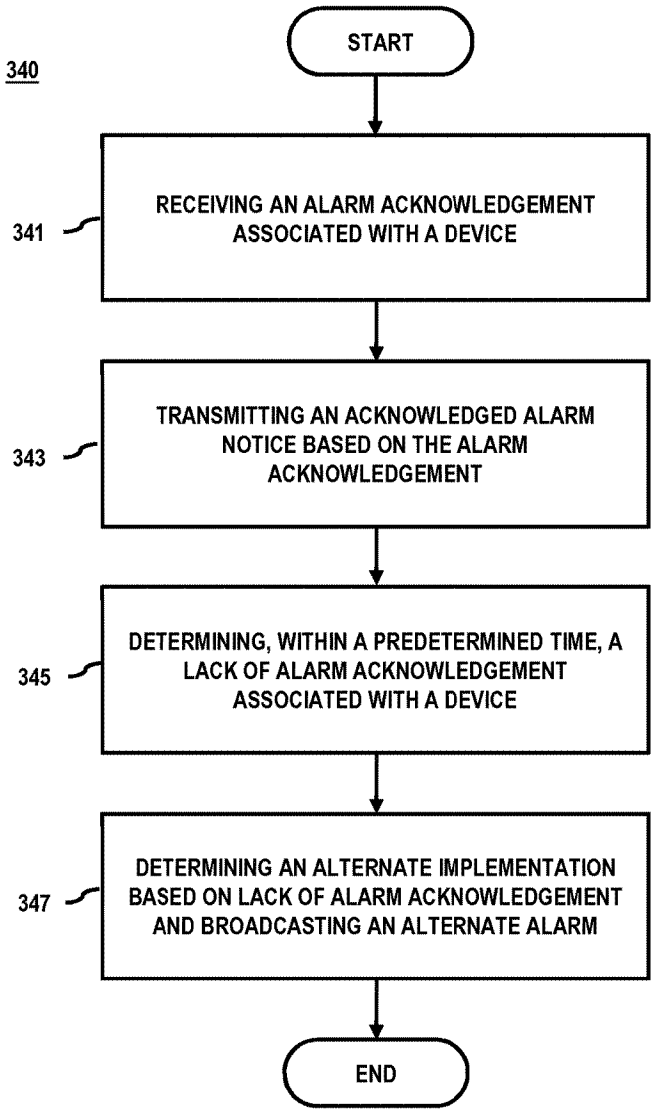

FIG. 3C is a flowchart of a process 340 for receiving an alarm acknowledgement, transmitting an acknowledged alarm notice, determining a lack of alarm acknowledgement, determining an alternate implementation and broadcasting an alternate alarm. The process 340 includes steps to provide assurance to remotely located alarm group members that all the group members have been adequately notified by an alarm, or an alternate alarm, if needed.

In step 341, the communication module 215 receives an alarm acknowledgement associated with at least one device of the plurality of devices. The alarm acknowledgement may originate from a member device after a member has received the alarm and initiated transmission of the alarm acknowledgement. In general, an alarm acknowledgement is to be transmitted within a predetermined period of time after the alarm is broadcast in order to confirm to other group alarm members that the alarm was effective.

In step 343, the server platform 115 or other host device transmits an acknowledged alarm notice based on the alarm acknowledgement received in step 341. The communication module 214 may transmit the acknowledged alarm notice to one or all of the group member devices associated with the group alarm.

In step 345, the server platform 115 or other host device performs a determination, utilizing the control module 211, whether there has been a lack of alarm acknowledgement associated with at least one device of the plurality of devices within a predetermined time period. As noted in FIG. 4, the predetermined period of time may, for example, be designated in an alarm request, such as the alarm acknowledgment deadline 413 in graphical representation 400. The alarm acknowledgment deadline 413 represents a predetermined period of time of five minutes, but may be varied according the according to the requirements of a user.

In step 347, the server platform 115, utilizing the rules engine 201, determines an alternate implementation of the alarm based on any lack of alarm acknowledgement determined in step 345, and utilizing at least one of the communication module 215 and the notification module 205, broadcasts an alternate alarm to the plurality of devices in the alarm group based on the alternate implementation. For example, if an alarm acknowledgement is not received within a predetermined period of time from one or more users, an alternate implementation may involve sending a louder alarm to the member devices associated with the lack of alarm acknowledgement. In another example, an alternate implementation may involve signaling member devices from which alarm acknowledgment has been received, either to notify the associated users of the lack of acknowledgement or to message them to use alternate means, beyond the group alarm, to contact the alarm group members from whom an alarm acknowledgement has not been received. In yet another example, an alternate implementation may include a system check, such as to confirm the networks 107-113 may be operating to provide an effective link across the wireline and/or wireless network(s).

Figure 3D:
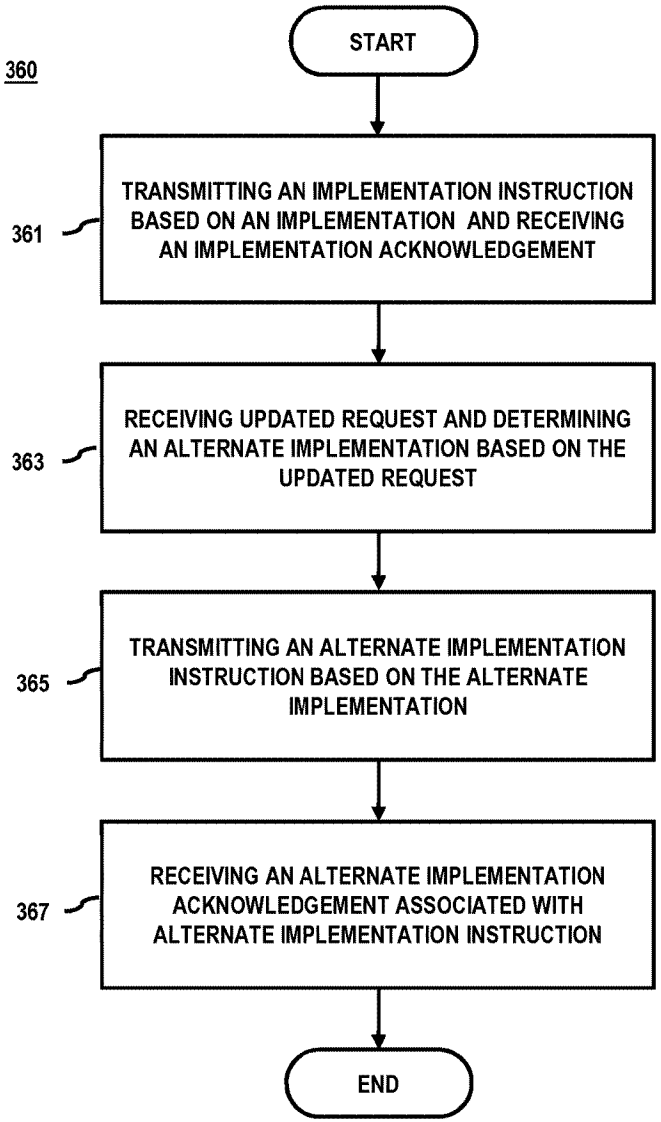

FIG. 3D is a flowchart of a process 360 for transmitting an implementation instruction, receiving an implementation acknowledgement, receiving an updated request, determining an alternate implementation, transmitting an alternate implementation instruction and receiving an alternate implementation acknowledgement. The process 360 includes steps to provide assurance to remotely located alarm group members that all the group members have been adequately updated regarding implementing, scheduling and/or rescheduling an alarm, or an alternate implementation associated with an alarm.

In step 361, the server platform 115 and/or a host device in the alarm group, via the notification module 205, transmits an implementation instruction based on the implementation determined in step 303 and the communication module 215 receives an implementation acknowledgement associated with the implementation instruction. In one example, an implementation acknowledgement is received within a predetermined period of time after the implementation instruction is transmitted to confirm that the other group alarm members have received the implementation instructions at their devices. If an implementation acknowledgement is not received within a predetermined period of time from one or more users, an alternate implementation instruction may be transmitted and/or a system check may be performed, such as to confirm the networks 107-113 may be operating to provide an effective link across the wireline and/or wireless network(s).

In step 363, the communication module 215 receives an updated request associated with the alarm group and the rules engine 201 determines an alternate implementation based on the updated request. In an example, an updated request may be sent from a member device for rescheduling an alarm. The rules engine 201 may determine an alternate implementation based on factors such as an alarm condition associated with any one of the plurality of devices, a device preference, a group preference, or a change notice received from a member device.

In step 365, the server platform 115, via the notification module 205, transmits an alternate implementation instruction based on the alternate implementation determined in step 363. The communication module 214 may transmit the alternate implementation instruction to one or all of the group member devices associated with the group alarm.

In step 367, the communication module 215 receives an alternate implementation acknowledgement associated with the alternate implementation instruction transmitted in step 365. In an example, an alternate implementation acknowledgement is received within a predetermined period of time after the alternate implementation instruction is transmitted to confirm that the other group alarm members have received the alternate implementation instructions at their devices. If an alternate implementation acknowledgement is not received within a predetermined period of time from one or more users, a second alternate implementation instruction may be transmitted and/or a system check may be performed, such as to confirm the networks 107-113 may be operating to provide an effective link across the wireline and/or wireless network(s).

FIG. 4 is a graphical representation 400 of an alarm request for a group alarm designating a plurality of devices as an alarm group. The alarm request may be input via an interface, such as interface 105*a* of UE 101*a* or the user interface module 213. The alarm request includes basic fields 401, including data entry fields for an alarm name, and alarm start, an alarm end, and an identification of the alarm group. The alarm request also includes a section 403 for an alarm organizer selection and a section 405 for data entry of alarm request specifications. In representation 400, the alarm request specifications include field for an alarm period 407, and alarm identification 409, an alarm time 411, an alarm acknowledgement deadline 413 and an alarm category 415. Graphical representation 400 also includes a send request command button 417 for sending the alarm request after the data fields have been completed.

FIG. 5 is a diagram of a computer system 500 that can be used to implement various exemplary embodiments. The computer system 500 includes a bus 501 or other communication mechanism for communicating information and a processor 503 coupled to the bus 501 for processing information. The computer system 500 also includes main memory 505, such as a random access memory (RAM) or other dynamic storage device, coupled to the bus 501 for storing information and instructions to be executed by the processor 503. Main memory 505 can also be used for storing temporary variables or other intermediate information during execution of instructions by the processor 503. The computer system 500 may further include a read only memory (ROM) 507 or other static storage device coupled to the bus 501 for storing static information and instructions for the processor 503. A storage device 509, such as a magnetic disk or optical disk, is coupled to the bus 501 for persistently storing information and instructions.

The computer system 500 may be coupled via the bus 501 to a display 511, such as a cathode ray tube (CRT), liquid crystal display, active matrix display, or plasma display, for displaying information to a computer user. An input device 513, such as a keyboard including alphanumeric and other keys, is coupled to the bus 501 for communicating information and command selections to the processor 503. Another type of user input device is a cursor control 515, such as a mouse, a trackball, or cursor direction keys, for communicating direction information and command selections to the processor 503 and for controlling cursor movement on the display 511.

According to one embodiment of the invention, the processes described herein are performed by the computer system 500, in response to the processor 503 executing an arrangement of instructions contained in main memory 505. Such instructions can be read into main memory 505 from another computer-readable medium, such as the storage device 509. Execution of the arrangement of instructions contained in main memory 505 causes the processor 503 to perform the process steps described herein. One or more processors in a multiprocessing arrangement may also be employed to execute the instructions contained in main memory 505. In alternative embodiments, hard-wired circuitry may be used in place of or in combination with software instructions to implement the embodiment of the present invention. Thus, embodiments of the present invention are not limited to any specific combination of hardware circuitry and software.

The computer system 500 also includes a communication interface 517 coupled to bus 501. The communication interface 517 provides a two-way data communication coupling to a network link 519 connected to a local network 521. For example, the communication interface 517 may be a digital subscriber line (DSL) card or modem, an integrated services digital network (ISDN) card, a cable modem, a telephone modem, or any other communication interface to provide a data communication connection to a corresponding type of communication line. As another example, communication interface 517 may be a local area network (LAN) card (e.g. for Ethernet™ or an Asynchronous Transfer Model (ATM) network) to provide a data communication connection to a compatible LAN. Wireless links can also be implemented. In any such implementation, communication interface 517 sends and receives electrical, electromagnetic, or optical signals that carry digital data streams representing various types of information. Further, the communication interface 517 can include peripheral interface devices, such as a Universal Serial Bus (USB) interface, a PCMCIA (Personal Computer Memory Card International Association) interface, etc. Although a single communication interface 517 is depicted in FIG. 5, multiple communication interfaces can also be employed.

The network link 519 typically provides data communication through one or more networks to other data devices. For example, the network link 519 may provide a connection through local network 521 to a host computer 523, which has connectivity to a network 525 (e.g. a wide area network (WAN) or the global packet data communications network now commonly referred to as the "Internet") or to data equipment operated by a service provider. The local network 521 and the network 525 both use electrical, electromagnetic, or optical signals to convey information and instructions. The signals through the various networks and the signals on the network link 519 and through the communication interface 517, which communicate digital data with the computer system 500, are exemplary forms of carrier waves bearing the information and instructions.

The computer system 500 can send messages and receive data, including program code, through the network(s), the network link 519, and the communication interface 517. In the Internet example, a server (not shown) might transmit requested code belonging to an application program for implementing an embodiment of the present invention through the network 525, the local network 521 and the communication interface 517. The processor 503 may execute the transmitted code while being received and/or store the code in the storage device 509, or other non-volatile storage for later execution. In this manner, the computer system 500 may obtain application code in the form of a carrier wave.

The term "computer-readable medium" as used herein refers to any medium, such as a non-transitory medium, that participates in providing instructions to the processor 503 for execution. Such a medium may take many forms, including but not limited to non-volatile media, volatile media, and transmission media. Non-volatile media include, for example, optical or magnetic disks, such as the storage device 509. Volatile media include dynamic memory, such as main memory 505. Transmission media include coaxial cables, copper wire and fiber optics, including the wires that comprise the bus 501. Transmission media can also take the form of acoustic, optical, or electromagnetic waves, such as those generated during radio frequency (RF) and infrared (IR) data communications. Common forms of computer-readable media include, for example, a floppy disk, a flexible disk, hard disk, magnetic tape, any other magnetic medium, a CD-ROM, CDRW, DVD, any other optical medium, punch cards, paper tape, optical mark sheets, any other physical medium with patterns of holes or other optically recognizable indicia, a RAM, a PROM, and EPROM, a FLASH-EPROM, any other memory chip or cartridge, a carrier wave, or any other medium from which a computer can read.

Various forms of computer-readable media may be involved in providing instructions to a processor for execution. For example, the instructions for carrying out at least part of the present invention may initially be borne on a magnetic disk of a remote computer. In such a scenario, the remote computer loads the instructions into main memory and sends the instructions over a telephone line using a modem. A modem of a local computer system receives the data on the telephone line and uses an infrared transmitter to convert the data to an infrared signal and transmit the infrared signal to a portable computing device, such as a personal digital assistant (PDA) or a laptop. An infrared detector on the portable computing device receives the information and instructions borne by the infrared signal and places the data on a bus. The bus conveys the data to main memory, from which a processor retrieves and executes the instructions. The instructions received by main memory can optionally be stored on storage device either before or after execution by processor.

FIG. 6 illustrates a chip set or chip 600 upon which an embodiment of the invention may be implemented. Chip set 600 is programmed to deliver messages to a user based on their activity status as described herein and includes, for instance, the processor and memory components described with respect to FIG. 5 incorporated in one or more physical packages (e.g., chips). By way of example, a physical package includes an arrangement of one or more materials, components, and/or wires on a structural assembly (e.g., a baseboard) to provide one or more characteristics such as physical strength, conservation of size, and/or limitation of electrical interaction. It is contemplated that in certain embodiments the chip set 600 can be implemented in a single chip. It is further contemplated that in certain embodiments the chip set or chip 600 can be implemented as a single "system on a chip." It is further contemplated that in certain embodiments a separate ASIC would not be used, for example, and that all relevant functions as disclosed herein would be performed by a processor or processors. Chip set or chip 600, or a portion thereof, constitutes a means for performing one or more steps of enabling the transmission of files independent of a file transfer application or the throughput capabilities of the sending or receiving devices.

In one embodiment, the chip set or chip 600 includes a communication mechanism such as a bus 601 for passing information among the components of the chip set 600. A processor 603 has connectivity to the bus 601 to execute instructions and process information stored in, for example, a memory 605. The processor 603 may include one or more processing cores with each core configured to perform independently. A multi-core processor enables multiprocessing within a single physical package. Examples of a multi-core processor include two, four, eight, or greater numbers of processing cores. Alternatively or in addition, the processor 603 may include one or more microprocessors configured in tandem via the bus 601 to enable independent execution of instructions, pipelining, and multithreading. The processor 603 may also be accompanied with one or more specialized components to perform certain processing functions and tasks such as one or more digital signal processors (DSP) 607, or one or more application-specific integrated circuits (ASIC) 609. A DSP 607 typically is configured to process real-world signals (e.g., sound) in real time independently of the processor 603. Similarly, an ASIC 609 can be configured to performed specialized functions not easily performed by a more general purpose processor. Other specialized components to aid in performing the inventive functions described herein may include one or more field programmable gate arrays (FPGA) (not shown), one or more controllers (not shown), or one or more other special-purpose computer chips.

In one embodiment, the chip set or chip 600 includes merely one or more processors and some software and/or firmware supporting and/or relating to and/or for the one or more processors.

The processor 603 and accompanying components have connectivity to the memory 605 via the bus 601. The memory 605 includes both dynamic memory (e.g., RAM, magnetic disk, writable optical disk, etc.) and static memory (e.g., ROM, CD-ROM, etc.) for storing executable instructions that when executed perform the inventive steps described herein to deliver messages to a user based on their activity status. The memory 605 also stores the data associated with or generated by the execution of the inventive steps.

While certain exemplary embodiments and implementations have been described herein, other embodiments and modifications will be apparent from this description. Accordingly, the invention is not limited to such embodiments, but rather to the broader scope of the presented claims and various obvious modifications and equivalent arrangements.

What is claimed is:

1. A method comprising:

receiving, via an alarm application, a request designating a plurality of devices as an alarm group, wherein the request also includes at least one specified time for an alarm, and the alarm group is based on contextual information associated with users of the plurality of devices;

determining, via a rules engine, an implementation of the alarm, based on the at least one specified time and alarm group data related to the plurality of devices, for the alarm group, wherein the alarm group data includes communication capabilities and device status of each of the plurality of devices in the alarm group; and broadcasting, via communication channels associated with the communication capabilities, the alarm to the plurality of devices in the alarm group based on the determination of the implementation of the alarm on the plurality of devices.

2. A method of claim 1, further comprising:

receiving, as part of the request, an instruction to personalize the alarm; and generating a personalized alarm based on the instruction, wherein the personalized alarm includes a voice capture, a video capture, a selected tone, a selected rhythm, a selected signal, or a combination thereof, and wherein the alarm that is broadcasted is the personalized alarm.

3. A method of claim 1, wherein the request originates from one device in the alarm group; and wherein the alarm is a wake-up alarm.

4. A method of claim 1, further comprising:

receiving an alarm acknowledgement associated with at least one device of the plurality of devices; and transmitting an acknowledged alarm notice based on the alarm acknowledgement.

5. A method of claim 1, further comprising:

determining, within a predetermined time period, a lack of alarm acknowledgement associated with at least one device of the plurality of devices;

determining an alternate implementation based on the lack of alarm acknowledgement; and broadcasting an alternate alarm to the plurality of devices in the alarm group based on the alternate implementation.

6. A method of claim 1, further comprising:

selecting the implementation based on an alarm condition associated with any one of the plurality of devices, a device preference, a group preference, or a combination thereof.

7. A method of claim 1, further comprising:

receiving a change notice associated with an activity state of at least one device of the plurality of devices; and initiating, based on the change notice, the request, the determining of the implementation, a determining of an alternate implementation, the broadcasting of the alarm, a broadcasting of an alternate alarm, or a combination thereof.

8. A method of claim 1, further comprising:

transmitting an implementation instruction based on the implementation; and receiving an implementation acknowledgement associated with the implementation instruction.

9. A method of claim 1, further comprising:

receiving an updated request associated with the alarm group;

determining an alternate implementation based on the updated request;

transmitting an alternate implementation instruction based on the alternate implementation; and receiving an alternate implementation acknowledgement associated with the alternate implementation instruction.

10. An apparatus comprising a processor configured to:

receive, via an alarm application, a request designating a plurality of devices as an alarm group, wherein the request also includes at least one specified time for an alarm, and the alarm group is based on contextual information associated with users of the plurality of devices;

determine, via a rules engine, an implementation of the alarm, based on the at least one specified time and alarm group data related to the plurality of devices, for the alarm group, wherein the alarm group data includes communication capabilities and device status of each of the plurality of devices in the alarm group; and broadcast, via communication channels associated with the communication capabilities, an alarm to the plurality of devices in the alarm group based on the determination of the implementation of the alarm on the plurality of devices.

11. An apparatus of claim 10, wherein the processor is further configured to:

receive, as part of the request, an instruction to personalize the alarm; and generate a personalized alarm based on the instruction, wherein the personalized alarm includes a voice capture, a video capture, a selected tone, a selected rhythm, a selected signal, or a combination thereof, and wherein the alarm that is broadcasted is the personalized alarm.

12. An apparatus of claim 10, wherein the request originates from one device in the alarm group; and wherein the alarm is a wake-up alarm.

13. An apparatus of claim 10, wherein the processor is further configured to:

receive an alarm acknowledgement associated with at least one device of the plurality of devices; and transmit an acknowledged alarm notice based on the alarm acknowledgement.

14. An apparatus of claim 10, wherein the processor is further configured to:

determine, within a predetermined time period, a lack of alarm acknowledgement associated with at least one device of the plurality of devices;

determine an alternate implementation based on the lack of alarm acknowledgement; and broadcast an alternate alarm to the plurality of devices in the alarm group based on the alternate implementation.

15. An apparatus of claim 10, wherein the processor is further configured to:

select the implementation based on an alarm condition associated with any one of the plurality of devices, a device preference, a group preference, or a combination thereof.

16. An apparatus of claim 10, wherein the processor is further configured to:

receive a change notice associated with a change in an activity state of at least one device of the plurality of devices; and initiate, based on the change notice, the request, the determining of the implementation, a determining of an alternate implementation, the broadcasting of the alarm, a broadcasting of an alternate alarm, or a combination thereof.

17. An apparatus of claim 10, wherein the processor is further configured to:

transmit an implementation instruction based on the implementation; and receive an implementation acknowledgement associated with the implementation instruction.

18. An apparatus of claim 10, wherein the processor is further configured to:

receive an updated request associated with the alarm group;

determine an alternate implementation based on the updated request;

transmit an alternate implementation instruction based on the alternate implementation; and receive an alternate implementation acknowledgement associated with the alternate implementation instruction.

19. A system comprising:

a platform configured to:

receive, via an alarm application, a request designating a plurality of devices as an alarm group, wherein the request also includes at least one specified time for an alarm, and the alarm group is based on contextual information associated with users of the plurality of devices;

determine, via a rules engine, an implementation of the alarm, based on the at least one specified time and alarm group data related to the plurality of devices, for the alarm group, wherein the alarm group data includes communication capabilities and device status of each of the plurality of devices in the alarm group; and broadcast, via communication channels associated with the communication capabilities, an alarm to the plurality of devices in the alarm group based on the determination of the implementation of the alarm on the plurality of devices.

20. A system of claim 19, wherein the platform is further configured to:

receive, as part of the request, an instruction to personalize the alarm; and generate a personalized alarm based on the instruction, wherein the personalized alarm includes a voice capture, a video capture, a selected tone, a selected rhythm, a selected signal, or a combination thereof, and wherein the alarm that is broadcasted is the personalized alarm.

* * * * *